US005207384A

United States Patent [19]

Horsting

[11] Patent Number: 5,207,384

[45] Date of Patent: May 4, 1993

[54] SWIRL GENERATOR FOR AN INJECTOR

[75] Inventor: John J. Horsting, Grafton, Va.

[73] Assignee: Siemens Automotive L.p., Auburn Hills, Mich.

[21] Appl. No.: 761,593

[22] Filed: Sep. 18, 1991

[51] Int. Cl.[5] ..... B05B 1/34; B05B 15/02

[52] U.S. Cl. ..... 239/463; 239/114; 239/585.4

[58] Field of Search ..... 239/585.1, 585.4, 585.5, 239/472, 473, 489, 482, 491–493, 464, 460, 451, 114, 463

[56] References Cited

U.S. PATENT DOCUMENTS 2,668,084 2/1984 Saxton ..... 239/491

4,971,254 11/1990 Daly et al. ..... 239/480

FOREIGN PATENT DOCUMENTS 217144 12/1909 Fed. Rep. of Germany ..... 239/482

70865 3/1991 Japan ..... 239/585.5

*Primary Examiner*—Andres Kashnikow

*Assistant Examiner*—Kevin Weldon

*Attorney, Agent, or Firm*—Russel C. Wells; George L. Boller

[57] ABSTRACT

In a fuel injector, a swirl generator operates to impart a tangential or swirl component to the fuel as it is expelled from the injector. The mass of the swirl generator is minimized so as to maximize the actuating speed of the injector. The swirl generator develops a pressure drop across the generator during the time the fuel is expelled which pressure drop aids in enhancing the closure time of the injector. The swirl generator provides damping to the needle valve upon both opening and closing. The swirl generator minimizes the volume of residual fuel remaining in the injector.

6 Claims, 2 Drawing Sheets

SWIRL GENERATOR FOR AN INJECTOR

FIELD OF THE INVENTION

This invention relates generally to fuel injectors and more particularly to swirl generators for imparting a swirling motion to the fuel as it exits the injector.

BACKGROUND OF THE INVENTION

Fuel injectors or solenoid operated injection valves perform the function of supplying fuel into the cylinders of internal combustion engines or adjacent to the intake valves of the cylinders of internal combustion engines. Depending on the characteristics of the engine, the fuel injector discharges its fuel in a pencil stream, a cone shaped spray, dual sprays, etc. all with or without the fuel having a toroidal or tangential or swirl motion applied thereto.

U.S. Pat. No. 4,971,254, ('254) issued on Nov. 20, 1990 to Daly et al and entitled "Thin Orifice Swirl Injector Nozzle" is illustrative of a fuel injector wherein the fuel is passed through a guide member upstream of a thin orifice member by a plurality of holes that are spaced radially outwardly from the axis of the guide member. As the fuel passes through these holes, the fuel acquires angular momentum which increases the divergence of the column of fuel that is emitted from the thin disc orifice member.

In this patent, '254, the guide member is stationary and rests on the conical seat member of the injector. When the needle is in its closed position, a small amount of residual fuel remains between the bottom of the guide member and the inlet of the seat member. When the needle is opened this small amount of residual fuel is dumped and only the subsequent fuel, the fuel passing through the guide member, will begin to exit the injector in a swirling manner.

SUMMARY OF INVENTION

It is an advantage to provide a swirl generator for use in fuel injectors wherein at least one member is fixed and another member is moveable.

It is a principal advantage of the swirl generator to impart the desired level of swirl flow component to the fluid immediately upon the opening of the injector and to maintain such desired level throughout the full range of volume flow of the valve.

It is another advantage of the swirl generator to substantially eliminate the residual volume of fluid in the swirl generator when the valve is closed by the moveable member of the swirl generator.

It is yet another advantage of the swirl generator to utilize the pressure drop across the moveable member of the swirl generator as a result of the flow of the fluid out of the swirl generator to improve the closing time of the injector when the energizing power is removed.

It is still yet another advantage of the swirl generator to provide damping on both the opening and the closing of the injector to eliminate bounce of the needle member.

These and other advantages are found in a swirl generator for a fuel injector having a needle member reciprocally moving between a closed position and one of a plurality of open positions. A valve seat member has a seating area around an orifice wherein the needle is operable to cooperate with the seating area to close the orifice. The swirl generator includes a fixed guide member attached to the valve seat member forming a swirl flow path beginning at the orifice and ending upstream from the guide member and a moveable member, having a plurality of lobes, coupled to the needle member and moveable therewith for defining in cooperation with the guide means a swirl flow volume having an axial flow path portion and a spiral flow path portion. The spiral flow path portion begins at the end of the axial flow path and ends at the orifice.

DESCRIPTION OF THE PREFERRED EMBODIMENT

Figure 1:
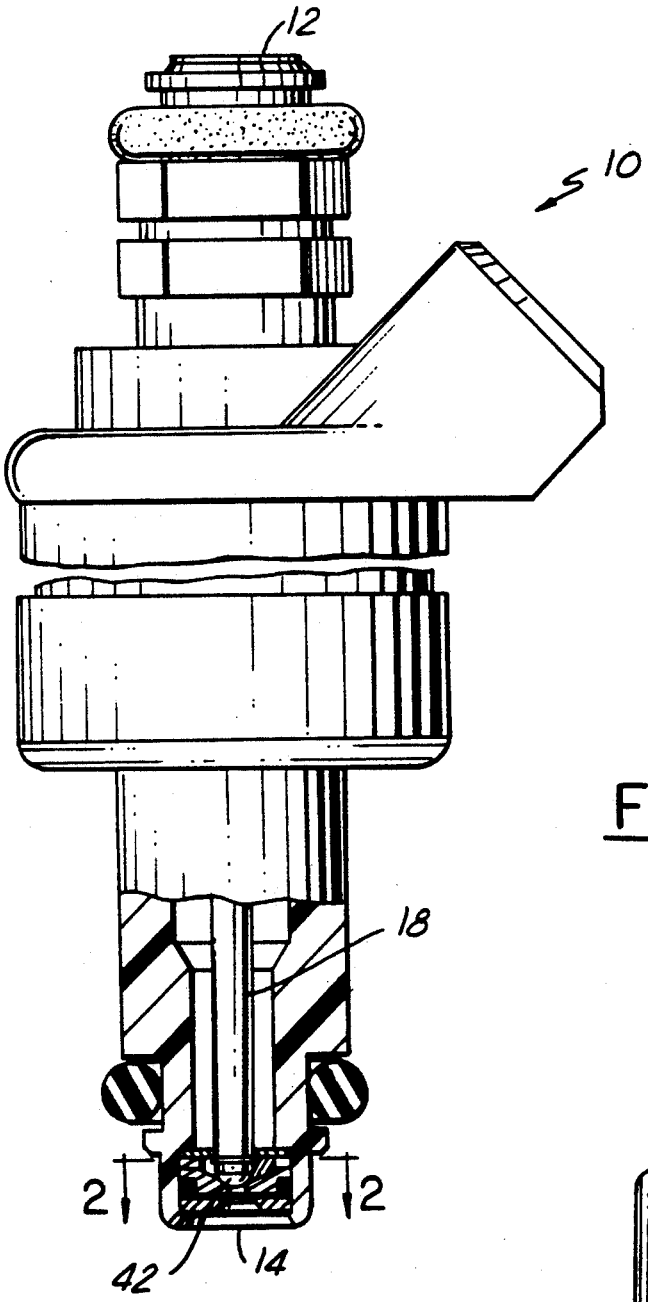
FIG 1 is a plan view of a top feed fuel injector with parts broken away to illustrate the swirl generator construction of the present invention.

FIG. 1 is a plan view of an injector 10 or valve wherein fuel is supplied to the fuel inlet 12 at the top of the injector and exits at the fuel outlet 14 at the bottom of the injector 10. The injector 10 of FIG. 1 is typically identified as a top feed injector. The present invention is directed to a swirl generator 16 in the nozzle area of the injector located at the fuel outlet end 14 and is shown in the broken away portion.

Figure 3:
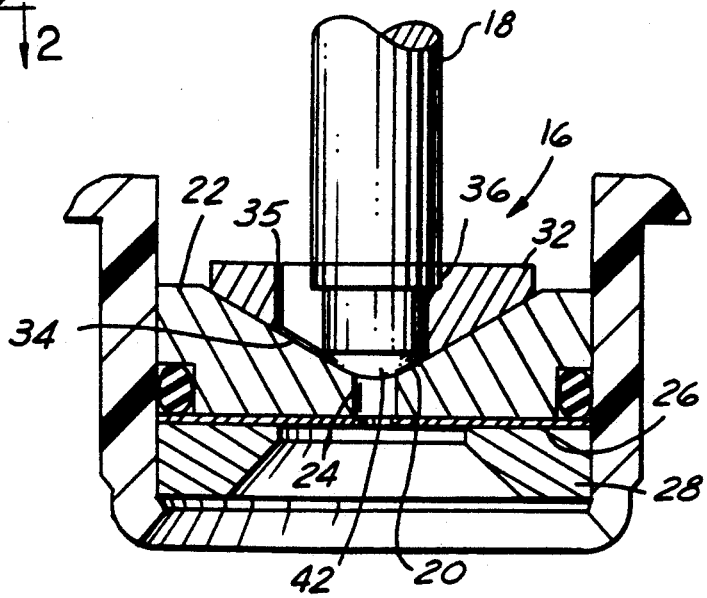
FIG. 3 is a sectional view taken along line 3—3 of FIG. 2.

Beginning with the fuel inlet 12 or upstream end of the injector 10, the injector has a needle 18 that is operated by a solenoid to control the passage of fuel from the nozzle. In FIG. 3, the needle 18 is guided in its reciprocal movement by the swirl generator 16. The end 20 of the needle, which may be a spherical or round surface 42 in the present embodiment, rests on the apex of the valve seat member 22 for closing off the flow of fuel from the inlet 12 to the outlet 14. Downstream in the valve seat member 22 is an aperture 24 through the valve seat member that directs the flow of fuel to the thin disc orifice member 26. The fuel flows through the thin disk orifice member and out of the injector. A retainer member 28 supports the thin disc orifice member.

The thin disc orifice may be an orifice member such as that described in any of the following U.S. Pat. Nos. 4,854,024; 4,923,169; 4,934,653; or 4,958,430.

Both FIGS. 1 and 3 illustrate the injector 10 in the deenergized or closed condition wherein the fuel is not flowing out of the injector. When the solenoid is energized, the needle 18 is lifted off of the valve seat member 22 and the fuel flows from the inlet 12 end of the injector, through the swirl generator 16 and out of the thin disk orifice member 26 at the outlet end 14 of the injector 10.

The swirl generator 16, in the present embodiment comprises at least one moveable lobe member 30 secured to the needle 18 and at least one fixed guide member 32 adapted to receive the lobe member 30. It is through the cooperation of these two members 30, 32, and the valve seat member 22 that the fuel passing through the injector 10 is imparted with a tangential or swirl component resulting in a swirl pattern. The splitting of the swirl generator 16 into multiple parts, including the lobe member 30 creates a moving mass, but by minimizing the moving mass the actuating energy is increased very little so that the actuating speed of the opening of the valve is not affected.

The valve seat member 22 forms a lower, nonmoving boundary of both the swirl generator 16 and the swirl volume 34. The bottom surface 44 of the lobe member 30 forms the upper boundary of the swirl volume 34. In injectors such as that shown in U.S. Pat. No. 4,971,254, there is a volume between the needle guide member 18 and the seat 26 of the valve seat member 20 wherein residual fuel is when the injector is closed. Upon opening of the orifice, this residual fuel dumps out of the injector.

The lobe member 30 substantially fills this volume so that the residual fuel, if any, remaining in the injector when it is closed is substantiality eliminated. The side surfaces 46 of the lobe member 30 with the guide member 32 form the side boundary of the swirl volume 35 as will hereafter be described. The guide member 32 is a stationary guide providing a side or axially extending face of the swirl volume 35. The guide member 32 cooperates with a lobe connecting band 36 on the lobe member 30 to guide the needle 18 in its reciprocal motion. The guide member 32 is secured in place by retaining means which is not shown.

Figure 2:
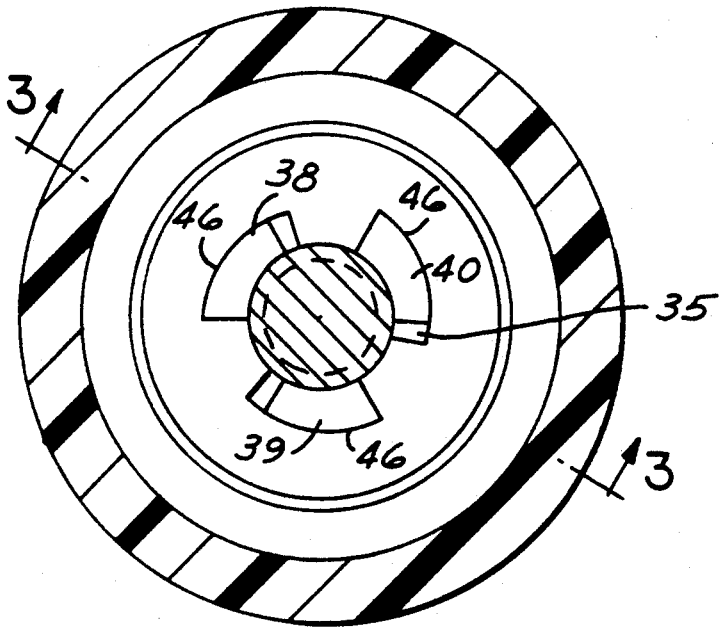
FIG. 2 a full horizontal sectional view taken along line 2—2 in FIG. 1.
Figure 4:
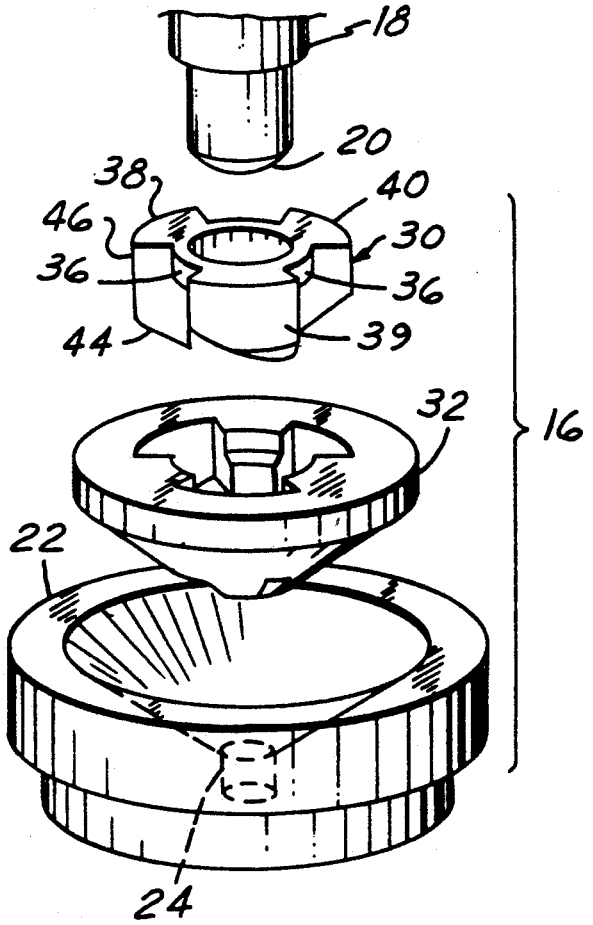
FIG. 4 is an exploded perspective view of the swirl generator of FIG. 1.

The lobe member 30, which in the drawings has three equally and angularly spaced lobes 38, 39, 40, is secured to the needle 18 and therefore reciprocates with the needle. In order to prevent the lobe member from rotating the radius of the outer periphery or side surface 46 of each lobe decreases in the clockwise direction as viewed in FIG. 2. Other methods of preventing rotation may be used such as positioning of a step in the guide member 32 so that the lobes can not rotate. Such a step would be to prevent the volume 35 from decreasing. The three lobes are connected by a lobe connecting band 36 which also functions to guide the needle 18 in the guide member 32. The lobes, when the needle 18 is seated on the valve seat member 22, provide a small axial swirl volume 35 extending axially along the side surface 46 of the lobes 38, 39, 40, to the valve seat member 22 surface and therealong another small swirl volume 34 to the aperture 24 in the valve seat member 22. In the preferred embodiment, the volume 34 between the bottom surface 44 of the lobes and the valve seat is very, very small so as to reduce the residual volume. It is not reduced to zero by intimate contact in order to prevent the fluid from forming an adhesion force, fluid sticking, tending to hold the lobes 38, 39, 40, in contact with the valve seat member 22. The round surface 42 of the end 20 of the needle 18 seals the aperture 24 and also limits the capacity of the swirl volume 34.

The guide member 32 is a cylindrically-shaped member having a conical end that is designed to fit within the conical shaped valve seat member 22 and held there by a retaining means, which is not shown. The portion of the guide member 32 along its axis has an opening of such a size and shape so as to receive the lobes 38, 39, 40, in a close tolerance fit on at least two sides of the lobes and having the bottom surface of the lobes in a close tolerance fit with the valve seat member. The third side in cooperation with the lobe member 30 forms an axially extending volume 35 of predetermined size.

When in operation, the solenoid is energized to axially move the needle 18 off of the valve seat member 22. As the needle 18 begins to move, the very small amount of residual fuel, if any, is dumped out of the injector and the fuel entrapped in the swirl volume 34 between the bottom of the lobes and valves seat begins to flow along the valve seat to the aperture 24. As the capacity of the swirl volume 34 increases commensurate with both the quantity and velocity of the flow, the fluid leaving the injector is at its desired level of swirl from the beginning and maintains that level throughout the full range of the volume of flow.

As the needle 18 moves further off the valve seat member 22, the lower portion 34 of the swirl volume increases and the fluid in the swirl volume 34, 35 flows along the valve seat member 22 between the surface of the seat and the bottom surface 44 of the lobes 38, 39, 40. This high velocity, low pressure fluid moving across the upper and lower boundaries of the swirl volume 34 urges the movable upper boundary, the bottom surface 44 of the lobes 38, 39, 40, toward the lower boundary which is the surface of the valve seat member 22, which is in opposition to the magnetic force lifting the needle 18. Therefore, when the power is removed from the solenoid, this pressure drop across the moveable member of the swirl generator operates to assist in the returning of the needle 18 to the valve seat member 22 and closing the valve.

The geometry of the swirl generator 16 and its mating parts provides damping means to eliminate bounce of the valve member, both on opening and closing. On opening, viscous damping is provided between the axial surface of the lobes 38, 39 and 40 and the adjacent surfaces in the guide member 32. On closing, the squeeze volume in the volume 35 provides fluid sheet damping. Of course, the volume 34 must be so created to avoid fluid or hydraulic sticking between the adjacent surfaces.

The geometry of the fluid path from the upper surface of the lobes 38, 39, 40 to the aperture 24 is in two portions. The first portion 35 is an axial path from the top of the lobes to the surface of the valve seat member 22 without any flow restrictions. The second portion 34 is a spiral converging path ending at the aperture 24. The second portion 34 of the swirl volume changes its volume as the needle 18 is retracted causing the fluid flow speed to increase hence forming a pressure drop across the swirl generator 16. The volume of the first portion is comparatively larger than the volume of the second portion 34. The dynamics of the design of the first and second portion are such that if the volume of the second portion is not converging and the area remains large, the area of low pressure is greater and the assist on the closing is greater. It is obvious that one must balance the area of low pressure and the amount of residual volume to achieve the desired characteristics of the injector.

While there has been illustrated a three-lobe lobe member 30, it is apparent that the number of lobes is a design choice.

What is claimed is:

1. A swirl generator for a fuel injector with a needle member reciprocally moving between a closed position and one of a plurality of open positions, a valve seat member having a seating area around an orifice, and the needle operable to cooperate with the seating area to close the orifice; the swirl generator comprising a fixed guide means having a plurality of equally and angularly spaced openings is attached to the valve seat member forming a swirl flow path; and a lobe means having a plurality of equally and angularly spaced lobes is coupled to the needle member and moveable therewith for defining in cooperation with said openings in said guide means for forming a swirl flow volume having an axial flow path portion and a variable volume spiral flow path portion; said spiral flow path portion beginning at the end of the axial flow path and ending at the orifice.

2. In the swirl generator for a fuel injector according to claim 1 wherein the side surfaces of each of said lobes cooperates with said openings in said guide means and the bottom surface cooperates with the surface of said spiral flow path in the valve seat member to substantially eliminate the residual volume of fluid when the injector is closed.

3. In the swirl generator for a fuel injector according to claim 1 wherein each of said lobes has its arcuate peripheral surface generated by means of a variable radius so as to prevent any rotation of said lobes in said openings in said guide means.

4. In the swirl generator for a fuel injector according to claim 1 wherein the opening of said needle creates an increasingly variable volume flow along the swirl flow volume thereby developing an increasing pressure drop across said lobe means of said swirl generator for assisting in returning the needle member upon closing.

5. In the swirl generator for a fuel injector according to claim 1 wherein said guide means and said lobe means provide viscous damping to the axial movement of said needle as said needle reciprocates to one of the plurality of open positions and fluid sheet damping as said needle reciprocates in the other direction to the closed position.

6. In the swirl generator for a fuel injector according to claim 1 wherein the opening of the needle by lifting the needle off of the valve seat forms a swirl volume of fluid so that the desired amount of swirl is developed and maintained through the full range of fluid flow.

* * * * *